US006273114B1

(12) United States Patent
Schaefer

(10) Patent No.: US 6,273,114 B1
(45) Date of Patent: Aug. 14, 2001

(54) MODULAR WALL TENT

(76) Inventor: Gary Schaefer, P.O. Box 390, Belgrade, MT (US) 59714

( * ) Notice: Subject to any disclaimer, the term of this patent is extended or adjusted under 35 U.S.C. 154(b) by 0 days.

(21) Appl. No.: 09/388,177

(22) Filed: Sep. 1, 1999

(51) Int. Cl.[7] ..... E04H 15/36
(52) U.S. Cl. ..... 135/128; 135/87; 135/97
(58) Field of Search ..... 135/87, 95, 97, 135/908, 128

(56) References Cited

U.S. PATENT DOCUMENTS 1,820,412 * 8/1931 Warren ..... 135/87 X
2,880,741 * 4/1959 McGrand ..... 135/87 X
2,932,304 * 4/1960 Voege et al. ..... 135/908 X
3,943,952 * 3/1976 Marquart et al. ..... 135/97 X
4,036,244 * 7/1977 Huddle ..... 135/97 X
4,078,572 * 3/1978 Moss ..... 135/97
4,979,532 * 12/1990 Johansson et al. ..... 135/97
5,394,897 * 3/1995 Ritchey et al. ..... 135/97 X

* cited by examiner

*Primary Examiner*—Peter M. Cuomo
*Assistant Examiner*—Stephen Vu
(74) *Attorney, Agent, or Firm*—DL Tschida

(57) ABSTRACT

A modular tent system that supports a number of detachable, weatherproof, self-supporting living quarter or storage pods. In a wall tent configuration, a primary tent is supported from a tubular framework. Each pod mounts to a covered access port of the primary tent. Each pod includes a separate support framework, side walls, floor and roof. Fasteners bordering the peripheral edges of the pod door flap and access port flap interconnect and secure the pod to the walls of the primary tent. Separate fasteners at the pod door flap and access port flap independently control access to the living space of the primary tent.

16 Claims, 3 Drawing Sheets

MODULAR WALL TENT

BACKGROUND OF THE INVENTION

The present invention relates to tents and, in particular, to a wall tent assembly having one or more self-supporting, weatherproof, personal living quarters or storage pods that attach to the walls of a primary tent.

Numerous varieties of tent constructions have been developed to appeal to particular concerns of targeted groups of users. Many designs provide lightweight constructions that accommodate temporary (i.e. overnight) bivouacs for backpackers. Other designs accommodate the intermittent, short-term recreational excursions with multiple persons sharing the same tent, for example, a single family or a group of friends (e.g. fishermen or hunters).

Some of the latter tents provide multiple rooms. The additional rooms frequently are defined by interior fabric or screen panels that are sewn into the surrounding tent walls, roof and/or floor to accommodate use by multiple occupants. The integral walls can define separate sleeping or living quarters or possibly a screen porch. Awnings or fly's are also frequently fitted to the doors or windows to provide shade or rain and/or wind protection.

Some tents accommodate detachable vestibules. The vestibules are constructed with open ends that contain fasteners that attach to the tent door. The vestibules typically do not include a floor. A separately fastened slit in the wall of the vestibule serves as a door to the space covered by the vestibule. Vestibules are principally constructed to provide a sheltered entry, storage or working space, prior to stepping onto the tent floor. Vestibules thus limit the tracking of dirt into the primary tent and/or provide a cooking or relaxation space sheltered from the elements yet which is attached and opens to the primary tent.

Modular tent systems have also been constructed. An example of one modular system is shown at U.S. Pat. No. 5,222,513. The awning of the tent is constructed such that a number of awnings can be connected to shelter a central common space. Filler panels mount between the sides of the ringed, individual tent units.

U.S. Pat. No. 4,063,566 discloses another tent that is constructed by securing the open sides of a number of identical open-sided, door-less sections together at fasteners mounted along the peripheral edges of each section. Once attached to each other, an open living space is defined by the attached sections. A door or access opening is defined by detaching one set of fasteners between two sections.

U.S. Pat. No. 3,965,915 discloses another modular tent system that can be constructed from a pair of identical, fully enclosed tent units. The separate units fasten to each other at fasteners positioned along the edges of the door sections. An access to the interior of the combined assembly is created upon detaching the fasteners along one edge of the mating door panels. An intermediate accessory unit can be mounted between the separate units. The accessory unit is open-sided and floor-less and essentially provides a panel that has fasteners along four edge sections that fasten to the doors of the facing units. The accessory unit is thus not capable of independent usage or use without a pair of mating tents, except as an awning.

The present tent system was constructed to be compatible with a primary wall tent having at least one door panel. One or more walls of the primary tent separately include flaps that can be opened to expose individual access ports into the primary tent. Fasteners displaced around each flap on the exterior side of the wall interconnect with fasteners secured around the periphery of a door of an independently supported pod that can be used as a personal living quarters storage space. The manner of attachment is such that the flap of the tent and door of the pod are separately operable. Each pod can thus be detached at any time and be erected as a standalone tent shelter at a remote site, such as a temporary, spike camp.

SUMMARY OF THE INVENTION

It is accordingly a primary object of the invention to provide a modular tent system that is capable of accepting a number of detachable, self-supported pods that open to the living space of a primary tent.

It is a further object of the invention to construct each pod to be weatherproof and self-supporting, when erected independent of or in combination with the primary tent.

It is a further object of the invention to support the corners of each pod with a number of support poles.

It is a further object of the invention to provide a self-supported primary tent having a number of access ports defined by flaps that are outlined with fasteners that separately interconnect to a detachable pod.

Various of the foregoing objects, advantages and distinctions of the invention are obtained in one presently preferred wall tent that accepts one or more pods. In a preferred construction, the wall tent is constructed from canvas and sewn panels define side and end walls and a roof. The tent is supported over a tubular framework and multiple guy ropes and stakes stabilize the tent. Doorways constructed of overlapping, flaps and interconnecting fasteners are formed at the end walls. A floor panel is not typically included due to the relatively large square footage encompassed beneath the tent (e.g. 80 to 415 square feet).

At least one of the walls includes one or more access ports. Each access port is bordered with peripheral fasteners at the external surface of the wall. The peripheral fasteners interconnect to fasteners that border the door of a detachable pod. The pod includes a floor, side walls, door and roof. A separate framework (e.g. a number of poles and staked guy ropes) supports the pod at the side of the primary tent. The attachment of the pod to the tent permits the pod door and the primary tent access port to be independently sealed or opened.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

BRIEF DESCRIPTION OF THE DRAWINGS

Similar structure at the drawings is referred to with the same reference numerals and/or characters.

DESCRIPTION OF THE PREFERRED EMBODIMENT

Figure 1:
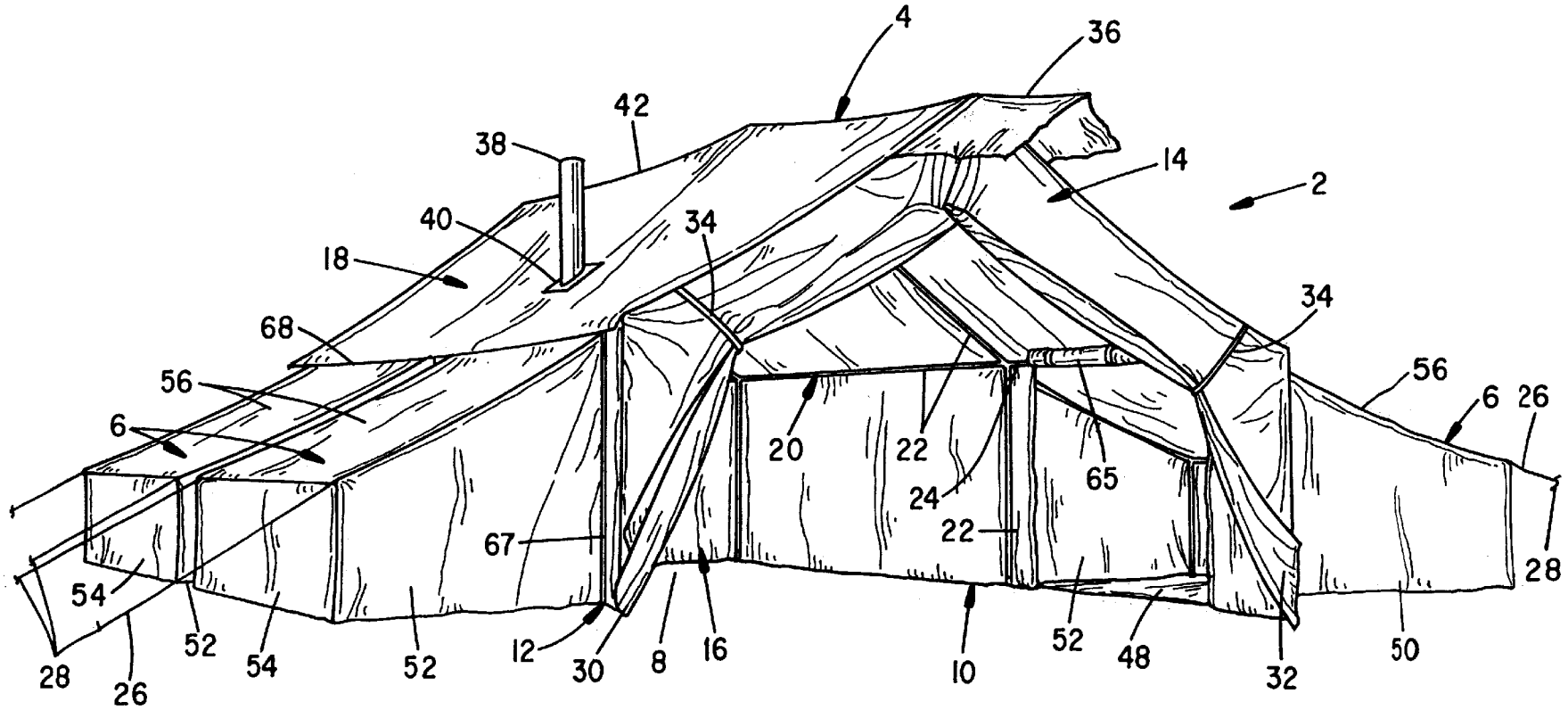
FIG. 1 is a perspective view of a central wall tent and several personal living quarters (PLQ) attached to the wall tent.

Referring to FIG. 1, a perspective view is shown to a modular tent system 2 that includes a primary tent 4. A number of personal living quarters (PLQ) pods 6 that define auxiliary living quarters or storage spaces are attached to the sides of the tent 4. Each pod 6 is accessible from a central space 8 encompassed beneath the tent 4.

The primary tent 4 includes side walls 10 and 12, end walls 14 and 16 and a roof 18. The tent 4 is supported from a tubular framework 20 that includes a number of interconnected frame pieces 22 and couplers 24. Guy ropes 26 and ground stakes 28 are arrayed from the tent 4 and pods 6 and support the assembly. Overlapping flaps 30 and 32 and strap fasteners 34 at one or both of the end walls 14 and 16 form a doorway to the central space 8. An awning 36 can be mounted to also extend from the tent 4 over the doorway. A chimney 38 extends from a covered stove jack 40. A wood stove (not shown) or other heating appliance couples to the chimney 38 to heat the living space 8.

The tent 4 is presently constructed from a durable canvas of an appropriate color and weight material (e.g. 7 to 12 oz.). A floor is not provided, although could be if desired. Instead, a short trim piece or sod cloth 41 extends from the bottom edges of the tent walls. The tent 4 can be constructed to any desired size, although typical sizes range from 8×10 to 16×23 feet and provide head room of 7 to 10 feet at the horizontal ridge pole 42. Additional details to the support framework 20, couplers 24 and typical construction of wall or "sheep herder" tents like the tent 4 can be found at U.S. Pat. 5,584,311. The tent 4 can, however, be constructed and supported in a variety of different fashions.

Figure 2:
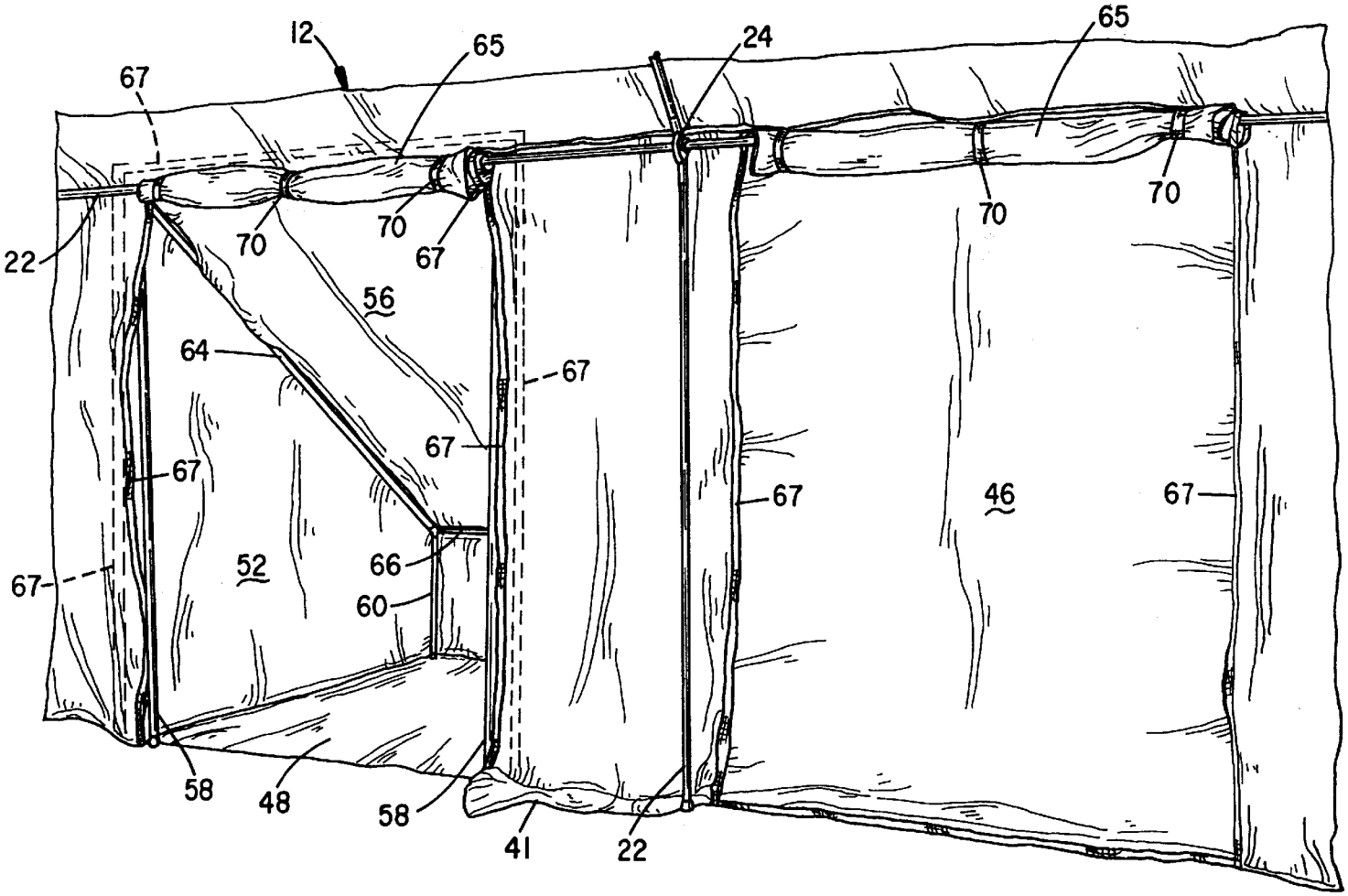
FIG. 2 is a perspective view showing a tent wall fitted with a pair of PLQs and wherein the interior of one PLQ is exposed and the door to the other PLQ is closed.
Figure 3:
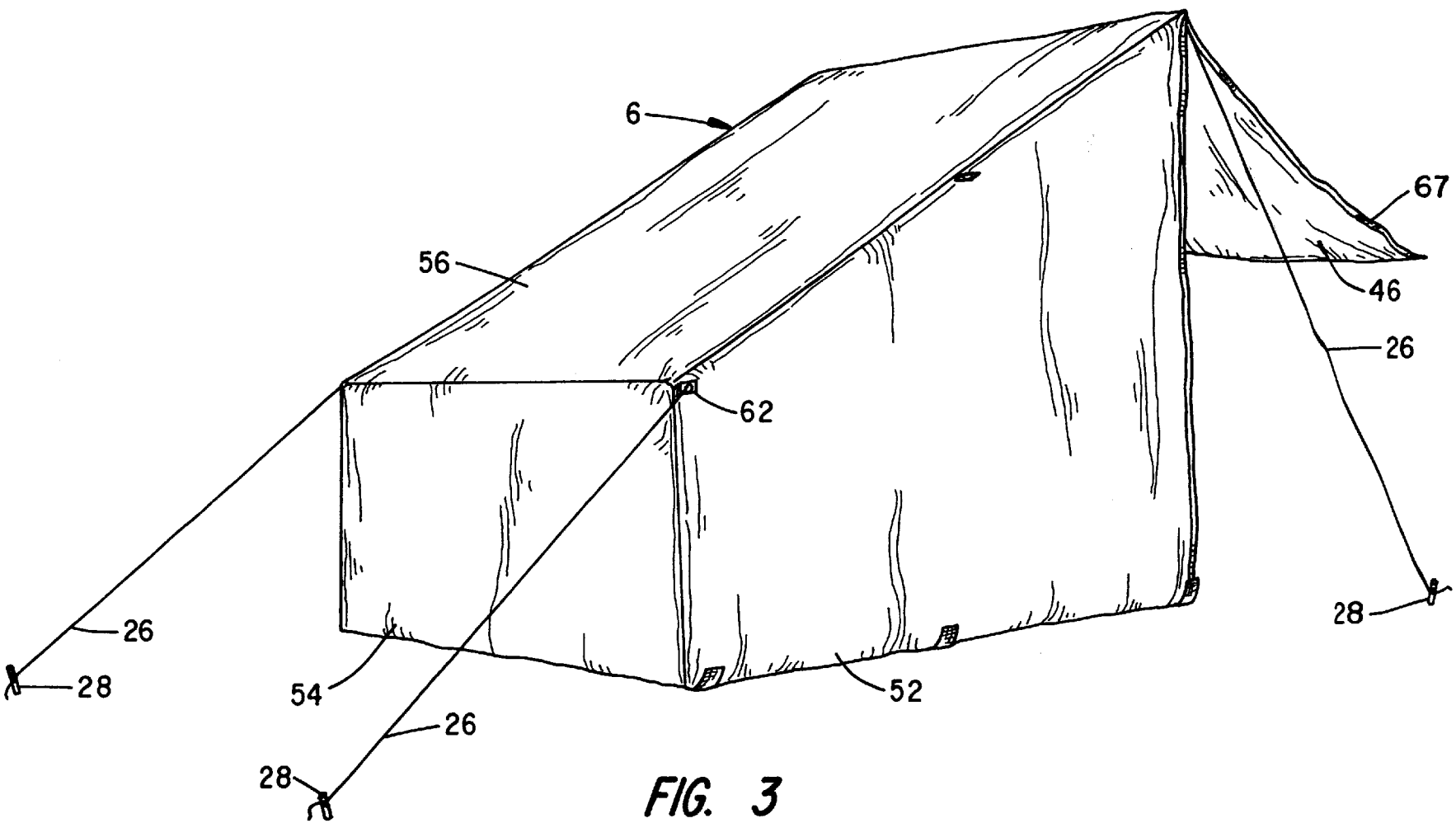
FIG. 3 is a perspective view of a self-supported PLQ as it appears when detached from the wall tent and erected at a remote site.

With additional attention to FIG. 2, each pod 6 is constructed to define a door flap 46 at a front wall 47, a floor 48, side walls 50 and 52, end wall 54 and a roof 56. Each pod 6 is supported from a pair of front poles 58 and a pair of rear poles 60 that mount in grommets 62 at the corners of the adjoining floor 48, roof 56 and walls 50 and 52. Interconnecting poles 64 and 66 can be fitted between the poles 58 and 60, although are not normally required when the guy ropes 26 are properly positioned and staked. The length of the poles 58, 60, 64 and 66 are sized as appropriate. At the tent 4, the poles 60 typically extend in the ranges of 30 to 48 inches and the poles 58 extend 60 to 84 inches. FIG. 3 depicts a pod 6 as it typically appears when detached and erected apart from the tent 4.

The front wall 47 of each pod 6 is secured to the tent 4 in alignment with an access flap 65. Interconnecting fasteners 67 (e.g. strips of hook and loop fastener material, zippers, buckles, snaps etc.) are particularly mounted to border the pod door flap 46 and each tent access flap 65. The mating fasteners 67 provide a weather tight attachment between pod front wall 47 and tent side walls 10 or 12. The displacement of the fasteners 67 from the separately fastened edges of the flaps 46 and 65 can be varied as desired. A three to twelve inch separation is typical. The support poles 58 and 60 and guy ropes 26 at the pod 6 and tent 4 reduce the stress on the fasteners 67. A strip of material or eave 68 is also provided along the edge of the tent roof 18 to cover the horizontal seam between each pod 6 with the tent 4.

The peripheral edges of the flaps 46 and 65 are separately secured at the adjoining pod front wall 47 and tent walls 10 or 12 with separate sets of mating fasteners 67. Zipper fasteners 67 are presently preferred for securing the flaps 46 and 65 to the pod and primary tent 4, since the flaps 46 and 65 are subject to the force of prevailing winds, when the pod 6 and tent 4 are mounted apart from each other. Narrow storm flaps can separately cover each strip of fasteners 67 at the flaps 46 and 65.

When a pod 6 is secured to the tent 4, the interior space of the pod 6 can be opened to the living space 8 and be warmed from the associated heat source or stove. When opened, the flaps 46 and 65 are typically rolled upward and supported with retainer straps 70. Alternatively, one or both of the flaps 46 or 65 can be lowered and/or fastened to provide privacy, if the pod 6 is used as a living and sleeping quarters. If used for storage, the pod 6 can be left open or not, depending upon concerns over the additional heating space. In all instances the weatherproof integrity of the pod 6 and tent 4 are maintained via the redundancy of the separate sets of fasteners 67 at the attachments between the wall surfaces 10, 12 and 47 and at the flaps 46 and 64 within the pod and tent walls.

As desired, the pod 6 can be detached Erom the tent 4, transported to a remote site and erected as a standalone shelter. This flexibility is particularly advantageous to hunters and fishermen, who may want to establish a durable base camp and from which intermittent over-night trips are made.

The redundant fastening of the invention is also in contrast to earlier systems that merely interconnected the peripheral edges of available door fasteners. Such mountings required special two-way zipper fasteners. The presently preferred use of hook and loop fasteners to attach the walls of the pods 6 to the walls of the tent 4 and one-way zippers at the edges of the flaps 46 and 65 reduces costs and provides effective, redundant fastenings.

While the invention has been described with respect to a preferred construction and considered improvements or alternatives thereto, still other constructions may be suggested to those skilled in the art. Selected ones of the foregoing features can also be arranged in different combinations. The foregoing description should therefore be construed to include all those embodiments within the spirit and scope of the following claims.

What is claimed is:

1. A tent system comprising:

a) a primary tent having a plurality of walls sewn to a roof, wherein a framework includes a plurality of interconnected frame members that assemble to support the primary tent and define an enclosed space, wherein a wall includes a first doorway that communicates with the enclosed space and that is defined by at least one slit having interconnecting first and second fasteners secured to adjoining edges of said slit at said first doorway and wall, and wherein a third fastener is secured to an external surface of the tent wall in substantially coextensive displaced bordering relation along the perimeter of said slit;

b) a second tent having a plurality of walls sewn to a roof, wherein a second framework includes a plurality of frame members that support the second tent and define an enclosed second space, wherein a wall includes a second doorway that communicates with the enclosed second space that is defined by at least one slit, wherein interconnecting fourth and fifth fasteners are secured to adjoining edges of the second slit at said second doorway and wall, and wherein a sixth fastener is secured to an external surface of the second tent wall in substantially coextensive displaced bordering relation about the perimeter of said second slit, whereby the second tent can be secured to the primary tent upon interconnecting said third and sixth fasteners and access between said primary and second tents is limited to disconnecting said first and second and fourth and fifth fasteners.

2. A tent system as set forth in claim 1 wherein said first doorway is defined by a pair of vertical slits that form a first flap, and wherein said first and second fasteners comprise interconnecting zipper pieces mounted to the adjoining peripheral edges of the primary tent wall and said first flap.

3. A tent system as set forth in claim 1 wherein the second doorway is defined by a pair of slits that form a second flap, and wherein said fourth and fifth fasteners comprise interconnecting zipper pieces mounted to the adjoining peripheral edges of the second tent wall and said second flap.

4. A tent system as set forth in claim 1 wherein said first doorway is defined by a pair of slits that form a first flap, wherein said first and second fasteners comprise interconnecting zipper pieces mounted to the adjoining peripheral edges of said first flap and said primary tent wall, wherein the second tent doorway is defined by a pair of slits that form a second flap, and wherein said fourth and fifth fasteners comprise interconnecting zipper pieces mounted to the adjoining peripheral edges of said second flap and said second tent wall.

5. A tent system as set forth in claim 4 wherein said third and sixth fasteners comprise interconnecting strips of hook and loop fastener material and wherein said roof includes an eave section that extends onto the roof of the second tent and over the second doorway.

6. A tent system as set forth in claim 1 wherein said second framework comprises a plurality of poles that couple to comers defined between the walls and roof of said second tent.

7. A tent system as set forth in claim 1 wherein said third and sixth fasteners comprise interconnecting strips of hook and loop fastener material.

8. A tent system comprising:

a) a primary tent having a plurality of walls sewn to a roof, wherein a framework includes a plurality of frame members that assemble to support the primary tent and define an enclosed space, wherein a wall includes a doorway that communicates with the enclosed space that is defined by a pair of slits that form a first access flap, and wherein first and second interconnecting zippers are mounted to adjoining edges of said slits at said first access flap and wall, and wherein at least one strip of hook and loop fastener material is secured to an external surface of said wall in substantially coextensive displaced bordering relation about the perimeter of said first access flap; and b) a second tent having a plurality of walls sewn to a roof, wherein a second framework includes a plurality of frame members that support the second tent and define an enclosed second space, wherein a wall includes a second doorway defined by a pair of slits that form a second access flap, wherein third and fourth interconnecting zippers are mounted to adjoining edges of said slits at said second access flap and wall, and wherein at least one strip of hook and loop fastener material is secured to an external surface of the second tent wall in substantially coextensive displaced bordering relation about the perimeter of said second access flap and aligned to interlock with the strip of hook and loop material at said primary tent, whereby the second tent can be secured to the primary tent upon interconnecting the strip. of hook and loop fastener material and access between said primary and second tents is limited to opening said first and second access flaps.

9. A tent system as set forth in claim 8 wherein the roof of the primary tent includes an eave section that extends onto the roof of the second tent and over the second doorway.

10. A tent system as set forth in claim 8 wherein said second framework comprises a plurality of poles that couple to corners defined between the walls and roof of said second tent.

11. A tent system comprising:

a) a primary tent having a plurality of walls sewn to a roof, wherein a framework includes a plurality of frame members that assemble to support the primary tent and define an enclosed space, wherein a wall includes a doorway that communicates with the enclosed space, wherein said walls include a plurality of first access apertures defined by a plurality of slits that form a plurality of first access flaps, and wherein first and second interconnecting zippers are mounted to adjoining edges of each of said slits at said plurality of first access flaps and wall, and wherein at least one strip of a fifth fastener is secured to an external surface of said wall in substantially coextensive displaced bordering relation about the perimeter of each of said first access flaps; and b) a plurality of second tents, wherein each of said second tents includes a plurality of walls sewn to a roof, a second framework having a plurality of frame members that support each second tent and define an enclosed second space, a wall that includes a second doorway defined by a pair of slits that form a second access flap, wherein third and fourth interconnecting zippers are mounted to adjoining edges of said slits at said second access flap and wall, and wherein at least one strip of a sixth fastener that interconnects with said fifth fastener is secured to an external surface of the second tent wall in substantially coextensive displaced bordering relation about the perimeter of said second access flap and aligned to mate with said fifth fastener, whereby each of the plurality of second tents can be secured to any of the plurality of access apertures at the primary tent upon interconnecting said fifth and sixth fasteners and access between each second tent and said primary tent is limited to opening said first and second access flaps.

12. A tent system comprising:

a) a primary tent having a plurality of walls sewn to a roof, wherein a framework includes a plurality of frame members that assemble to support the primary tent and define an enclosed space, wherein a wall includes a doorway that communicates with the enclosed space, wherein one of said walls includes an access aperture defined by a pair of slits that form a first access flap, wherein first and second fasteners are mounted to adjoining edges of said first access flap and wall, and wherein a third fastener is secured to an external surface of the second tent wall in substantially coextensive displaced bordering relation about the perimeter of said first access flap; and b) a second tent having a plurality of walls sewn to a roof, wherein a second framework includes a plurality of frame members that support the second tent and define an enclosed second space, wherein a wall includes a second doorway defined by a second pair of slits that form a second access flap, wherein fourth and fifth fasteners are mounted to adjoining edges of said second access flap and wall, and wherein a sixth fastener that interconnects with said third fastener is secured to an external surface of the second tent wall in substantially coextensive displaced bordering relation about the perimeter of said second access flap, whereby the second tent can be secured to the primary tent upon interconnecting said third and sixth fasteners and access between the primary and second tents is limited to opening said first and second access flaps.

13. A tent system as set forth in claim 12 wherein said third and sixth fasteners comprise interlocking strips of hook and loop fastener material.

14. A tent system as set forth in claim 12 wherein said third and sixth fasteners comprise interconnecting zippers.

15. A tent system as set forth in claim 11 wherein said fifth and sixth fasteners comprise interlocking strips of hook and loop fastener material.

16. A tent system as set forth in claim 11 wherein said fifth and sixth fasteners comprise interconnecting zippers.

* * * * *